US008272845B1

(12) United States Patent
Watson

(10) Patent No.: US 8,272,845 B1
(45) Date of Patent: Sep. 25, 2012

(54) SYSTEMS AND METHODS FOR ASYMMETRICAL PUMPING IN LOW SPEED, LOW VOLUME FLUID RECOVERY OPERATIONS

(76) Inventor: Jerry L. Watson, Fort Worth, TX (US)

( * ) Notice: Subject to any disclaimer, the term of this patent is extended or adjusted under 35 U.S.C. 154(b) by 699 days.

(21) Appl. No.: 12/394,268

(22) Filed: Feb. 27, 2009

Related U.S. Application Data

(60) Provisional application No. 61/067,697, filed on Mar. 1, 2008.

(51) Int. Cl.
*F04B 49/06* (2006.01)
*F04B 35/00* (2006.01)
*F16H 21/32* (2006.01)

(52) U.S. Cl. ..... 417/53; 417/328; 74/41

(58) Field of Classification Search ..... 417/53, 417/328, 555.2; 74/41
See application file for complete search history.

(56) References Cited

U.S. PATENT DOCUMENTS 2,180,880 A * 11/1939 Poulsen ..... 74/24
2,294,094 A * 8/1942 O'Leary ..... 74/591
2,631,011 A * 3/1953 Kendrick ..... 175/56
2,972,254 A * 2/1961 Lambert ..... 73/864
3,406,581 A * 10/1968 Eyler et al. ..... 74/41
4,603,592 A * 8/1986 Siebold et al. ..... 74/41
5,441,108 A * 8/1995 Jenkins et al. ..... 166/53

* cited by examiner

*Primary Examiner* — Charles Freay
(74) *Attorney, Agent, or Firm* — Fulbright & Jaworski L.L.P.

(57) ABSTRACT

Systems and methods for asymmetrical pumping in low speed, low volume fluid recovery. According to the system and method, fluid is recovered from a well using an asymmetrical recovery motion. A walking beam is actuated about a first pivot point between an upstroke motion and a downstroke motion in response to rotation of a crank wheel. The crank wheel rotates more than 180 degrees during the upstroke and rotates less than 180 degrees during the downstroke. Further, the walking beam and the crank wheel are in communication with one another by an arm extending there between, wherein the arm is positioned on an opposite side of the first pivot point from the well.

14 Claims, 7 Drawing Sheets

SYSTEMS AND METHODS FOR ASYMMETRICAL PUMPING IN LOW SPEED, LOW VOLUME FLUID RECOVERY OPERATIONS

CROSS-REFERENCE TO RELATED APPLICATIONS

This application claims priority to U.S. Provisional Patent Application No. 61/067,697 filed Mar. 1, 2008 entitled "A Specialized Oil/Gas Industry Pumping Unit With Special Design FEATURES For Low Volume. High Efficiency Pumping Utilizing Fiberglass Sucker Rods;" and is related to U.S. patent application Ser. No. 12/394,206, entitled "Systems and Methods For AUTOMATIC BELT TENSIONING IN LOW SPEED, LOW VOLUME Fluid Recovery Operations," filed concurrently herewith, and U.S. patent application Ser. No. 12/394,242, entitled "SYSTEMS AND METHODS For providing adjustable counterbalance in LOW SPEED, LOW VOLUME FLUID RECOVERY operations," filed concurrently herewith; the disclosures of which are all incorporated herein by reference.

TECHNICAL FIELD

The present disclosure relates to fluid recovery. More specifically, the present disclosure relates to systems and methods for low speed, low volume fluid recovery, and even more specifically to oil field recovery systems.

BACKGROUND OF THE INVENTION

Most known fluid recovery units are designed to maximize the amount of recovered fluid over a given length of time. These pumps, which pump a relatively large amount of fluid at a relatively high rate, typically operate with a symmetrical upstroke and downstroke. For instance, where such systems are driven by a crank wheel, the upstroke occurs over about 180 degrees of crank wheel rotation as does the downstroke. This scheme is desirable in high volume, high speed recovery systems because the upstroke, i.e., the only portion of unit motion where fluid is actually recovered, should occur at as high a frequency as possible. When the upstroke occurs at a high frequency, more fluid is pumped to the surface. However, the benefit provided by a fast, high frequency upstroke is offset by the costs associated with such an operation. Specifically, such a scheme places substantial shock loads on the recovery unit as the fluid and moving components are required to undergo relatively high accelerations. Moreover, these systems require a large amount of work to be performed in order to lift a higher weight of fluid per unit of time. Nevertheless, these offsetting costs are considered to be acceptable in view of the large amount of fluid that is brought to the surface. In sum, these systems remain profitable as long as an adequate amount of fluid is recovered, despite the large amount of work required to recover the fluid.

However, the considerations mentioned above are not usefully applied to a recovery unit operating at low speed, in a low volume well. In that case, the primary goal is not to recover a maximum amount of fluid per given length of time. Instead, the primary goal is to efficiently recover what fluid is available. Accordingly, a recovery unit operating with a symmetrical upstroke and downstroke is not desirable for a low volume, low speed recovery unit. In such case, the operating costs associated with a high frequency upstroke, namely the shock loads exerted upon the system and the high amount of work performed, outweigh the value of the recovered fluid.

Ideally, a recovery unit operating to recover a low volume of fluid would do so in a way that minimizes work performed. As a natural result, such a system would recover fluid so that the recovered fluid and moving components are subject to low accelerations.

Notwithstanding the above, known fluid recovery systems are subject to other additional limitations. Namely, a number of design features found in known recovery systems leave much to be desired. These design features limit system productivity and increase operating costs, particularly where those systems are used to recover fluid while operating at low strokes per minute (SPM).

By way of example, known recovery systems are limited in efficiency because they utilize too many structural bearings. The number of structural bearings in a system is inversely related to mechanical advantage (as each bearing introduces parasitic loads in the form, e.g., friction, heat, etc.). As a natural result of these inefficiencies, known recovery units need intensive maintenance, requiring relubrication every 3 to 6 months. Also, such systems must run above a threshold stroke per minute rate (SPM) to maintain lubrication between working components. As such, these systems cannot be used for low SPM applications.

Known recovery systems are also overly expensive to build and operate as they incorporate a relatively large gearbox, which is required to handle the full torque capacity rating of the recovery unit. Larger gearboxes cost significantly more to manufacture than smaller gearboxes. Some known systems utilize a belt drive between the motor and gearbox, where the gearbox output drives the crank arm. However, such an arrangement requires that the gearbox have a torque capacity at least as large as that of the recovery unit. Other known systems utilize two belt drives but do not achieve additional speed reduction between those drives (e.g., where a flywheel is used between the first and second drive). However, such a combination is particularly undesirable for low SPM operations because of the high rotational inertia effect of the flywheel.

Moreover, the majority of known recovery units typically have symmetrical operating geometries, meaning that it takes about 180 degrees of crankshaft rotation for the recovery unit to move the polished rod up or down in the well. This is often a necessary feature where the unit is operated at a relatively high SPM rate, typically 5 SPM to 15 SPM. However, these high SPM systems waste much energy when a low volume well is being pumped.

Known recovery units tend to suffer from a high cyclic load factor (CLF), which is defined as the quotient of the root-mean-square and average motor current. The CLF can be interpreted as a measure of electrical heating and cyclic loading observed during operation. The symmetrical operating geometry and relatively high speeds associated with known recovery systems (as mentioned above) largely contribute to the high CLF of known systems.

Other systems known in the art operate at a mechanical disadvantage as they utilize either of 1) a dual pitman arm arrangement, or 2) a single pitman arm arrangement that is not counterbalanced. As a result, these systems suffer from side loading on system bearings and/or a propensity to rotate about an axis drawn between the center of the wrist pin and tail bearing. This can cause unusual wear and early failures. Known systems are at a further disadvantage because they require manual adjustments in order to maintain tension across their drive belts. That is, the distance between drive components must be manually adjusted to maintain tension on belts extending therebetween. This is cumbersome and expensive in terms of manual labor and system downtime.

BRIEF SUMMARY OF THE INVENTION

The present invention solves the problems described above. In doing so, the present invention provides a method and system for recovering underground fluid from a well using an asymmetrical recovery motion. According to the system and method, a walking beam is actuated about a first pivot point between an upstroke motion and a downstroke motion in response to rotation of a crank wheel. The crank wheel rotates more than 180 degrees during the upstroke and rotates less than 180 degrees during the downstroke. Further, the walking beam and the crank wheel are in communication with one another by an arm extending there between, wherein the arm is positioned on an opposite side of the first pivot point from the well.

In accordance with the description above, the present invention is generally directed to systems and methods for improved fluid recovery. As part of these systems and methods, the invention disclosed herein improves the efficiency of belt driven systems and improves the way in which torque loads are handled by those systems. These improvements are the result of a recovery system that is designed to efficiently operate at low SPM, e.g., 2 SPM to 5 SPM. As will be described in more detail, the design provides, among other things, a system having an asymmetrical and slow upstroke, a three stage speed reduction, a relatively small gearbox, automatic belt tensioning, and the effect of an adjustable counterbalance.

As a result of the features described above, preferred embodiments of the present invention provide a recovery system whereby fiberglass rods can be used in place of steel rods. The use of fiberglass rods in place of steel rods is possible because systems according to the present invention subject the rods to low acceleration. For a given load and cross section, fiberglass rods stretch further than steel rods. As such, when fiberglass is used, the initial phase of the upstroke does not move the pump, and accordingly, no work associated with moving the fluid is being performed during the initial phase.

The recovery unit effectively reduces the number of parasitic loads exerted upon the recovery system by reducing the number of required bearings for operation. As such, the recovery unit utilizes only a single tail bearing assembly, a single wrist pin bearing assembly, a single Sampson shaft bearing assembly, and a single crankshaft bearing assembly. The reduction in required structural bearings reduces operating friction, heat, and the need for lubrication. Also, the crankshaft does not rotate, but instead the bearing housing rotates about the crankshaft. These features effectively improve the operating efficiency of the recovery unit.

The recovery unit gearbox is approximately only ⅕ of the recovery unit torque capacity. This feature is possible because the belt ratio between the gearbox output sheave and the crank wheel provides a step up in torque to achieve unit rated torque capacity. As a result, manufacturing costs are greatly reduced.

The recovery unit is specifically designed to operate at low strokes per SPM (e.g., in the range of 2 to 5 SPM). This design results in a geometry of the recovery unit that provides several benefits not otherwise available. By way of example, maintenance intervals are greatly extended because the slow rotational speeds and sealing of the bearings extend maintenance intervals to an order of 3 to 5 years.

Also, the geometry contributes to high energy efficiency. That is, the recovery unit achieves an upstroke speed that is slower than the down stroke speed, where the upstroke is fully achieved in 204 degrees of crankshaft rotation. The slower upstroke speed yields a lower acceleration force on the polished rod. Since force is equal to the product of mass and acceleration, a lower acceleration on the polished rod and recovered fluid will require a lower force or required energy to lift the same. This lower force translates into a reduced power requirement from the electric motor. Also, as mentioned, the utilization of much lighter weight sucker rods (i.e., fiberglass) reduces the mass that must be accelerated. This reduced mass along with lower acceleration further improves energy efficiency.

The geometry, in combination with lightweight fiberglass rods, produce a lower Cyclic Load Factor (CLF). As used herein, CLF is defined as the quotient of the root-mean-square and average motor current, and is a measure of electrical heating and cyclic loading. It is very desirable to achieve the lowest possible CLF, as doing so improves operating efficiency by lowering energy waste due to unnecessary electrical heating and reduces the horsepower rating of the electrical motor necessary to run the installation. To accomplish a lower CLF, a modified geometric motion of the 4 bar linkage is used to produce a polished rod motion that is conducive to lower CLFs. This modified geometric motion generates an asymmetrical upstroke having low speed and low acceleration. As will be further discussed, the slow operating speeds allow the geometry to use a 204 degree crank wheel rotation to fully achieve the upstroke. Finally, the low modulus of elasticity of fiberglass as compared to steel rods means that, as an abrupt change in load is encountered, fiberglass rods will stretch like a spring and absorb this impact and dampen the load change at the surface.

Operating efficiency is also improved by utilizing a combination of 1) an adjustable counterbalance weight along the walking beam and 2) an adjustable, phased rotating counterbalance weight along the crank wheel. As used herein, the counterbalance is the effort necessary to counterbalance the buoyed weight of the rod string and the load due to the weight of fluid being lifted.

The geometry also provides a recovery unit that has a much lower torque capacity-to-stroke length ratio. The American Petroleum Institute (API) has a method of rating recovery units that uses a number consisting of three groups. The first group is the torque rating of the unit x1000 in in-lb. (e.g., 80,000 in-lb). The second group is the structural rating of the unit, i.e., how much polished rod load the unit can support x100 (e.g., 10,900 lbs.). The third group is the stroke length of the unit in inches (e.g., 42 inch stroke). A complete list of these ratings is given in "API standard 11 E," which is incorporated herein by reference. The recovery unit has low torque and structural ratings for a give stroke length, e.g., 25-30-58. This is made possible by utilizing fiberglass rods. The combination of lower torque and structure ratings further reduces energy consumption and the cost to manufacture the unit.

Preferred embodiments further provide a recovery unit that utilizes a single pitman arm which has an adjustable counterbalance to reduce axial rotation about a line drawn from the center of the wrist pin bearing through the center of the tail bearing. Utilizing a single pitman arm allows all the structural bearing centerlines to fall on a common plane. This eliminates any side loading on the bearings. This feature also minimizes the parasitic loads exerted upon the recovery unit structure and minimizes manufacturing cost.

Preferred embodiments further provide a recovery unit that utilizes a geometric motion of the polished rod that causes the rod to rise more slowly, thereby providing greater mechanical advantage on the upstroke. As mentioned, geometries of prior art pumping units provide for the upstroke and down stroke polished rod velocities to be similar. This is to accommodate higher pumping speeds associated with higher volumes of recovered fluid. However, because of the slow operational speeds of the present invention, the geometry has been designed to provide for a much slower upstroke and a more rapid down stroke. To that end, the upstroke is accomplished in a range of 175 to 225, and preferably 204 degrees, of crank wheel rotation. This slower upstroke means that the unit has a greater mechanical advantage of the linkages on the upstroke when the unit is subject to a maximum well torque. This greater mechanical advantage tends to lower the CLF and correspondingly uses less energy.

Preferred embodiments further provide a recovery unit that automatically adjusts belt tension under varying operating conditions, i.e., changing operating speed and torque loads. According to one aspect of the tensioning system, the weight of the motor, the weight of the gearbox, reactionary motor stator torque, and motor mount rotation are all utilized to accomplish belt tensioning. According to another aspect of the tensioning system, the belt drive between the gearbox output and crank wheel is automatically adjusted using a spring acting upon the gearbox swing assembly. As the operational torque increases, the belt is tightened, and as the torque requirement decreases, the belt tension is relaxed. This action automatically adjusts for the required belt tension and also adds greatly to belt life because the belt only experiences high tensioning forces when they are needed to transmit the required torque. Accordingly, the tensioning system greatly reduces the maintenance requirements of the unit.

Preferred embodiments further provide a recovery unit that achieves speed reduction between its respective drives to operate at low SPM. According to this aspect of the invention, speed is reduced in three stages: 1) along a first belt drive between the motor and gearbox, 2) at the gearbox, and 3) along a second belt drive between the gearbox and crank wheel. By way of example, consider a typical scenario where motor RPM is 1750. In that scenario, the motor RPM must be reduced to 2 to 5 RPM (SPM) at the crank wheel. At the same time, the drive must have the torque capacity to meet the rating of the recovery unit. These requirements are satisfied by speed reduction between the three stages discussed above.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Figure 1:
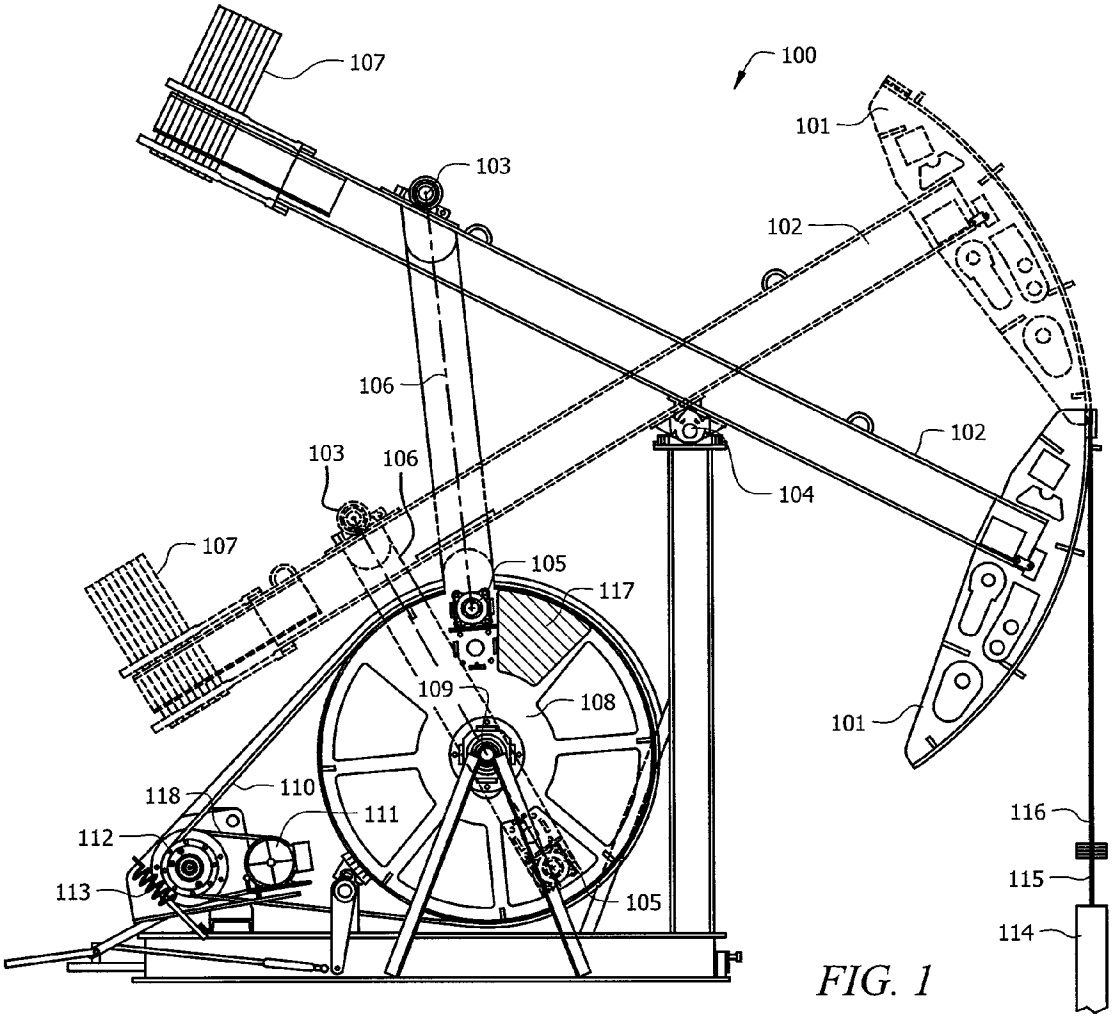
FIG. 1 is side view of a system according to a preferred embodiment of the present invention.

FIG. 1 depicts a preferred embodiment of the present invention. According to the depicted embodiment, system 100 is an oil well recovery pump for recovering fluid from beneath the surface. System 100 comprises horse head 101 positioned at one end of walking beam 102, which is actuated between a first position, e.g., top dead center (TDC), and a second position, e.g., bottom dead center (BDC) as part of system 100's operation to recover fluid. To that end, as walking beam 102 is actuated between its top and bottom position, horse head 101 undergoes an up and down motion. Accordingly, briddle line cable 116, extending between horse head 101 and polished rod 115, causes polished rod 115 to reciprocate within well head 114. This action ultimately causes fluid to be pumped to the surface.

As seen, walking beam 102 is actuated about a support point, which in the depicted embodiment, is Sampson bearing center 104. On the opposite side of walking beam 102 from horse head 101 is tail bearing center 103 and adjustable beam counterbalance weights 107. Pitman arm 106 extends from tail bearing center 103 to wrist pin center 105, which itself is located on crank wheel 108. During operation of system 100, crank wheel 108 rotates about an axis at crank shaft center 109. As crank wheel 108 rotates, wrist pin center 105 sweeps out a circle defined by the circumference of crank wheel 108. As a result, the end of pitman arm 106 connected at wrist pin center 105 also undergoes circular motion, and in doing so, rises and falls between a maximum and minimum height. This rise and fall motion causes pitman arm 106 at tail bearing center 103 to reciprocate between a top and bottom position, and therefore, this rise and fall motion is translated to walking beam 102.

The rotation of crank wheel 108 is driven by electric motor 111 in combination with speed reducer 112, which may be, e.g., a planetary-type reducer. According to the embodiment depicted at FIG. 1, electric motor 111 drives speed reducer 112 via belt 118. In response, speed reducer 112 drives crank wheel 108 via belt 110. It should be appreciated that this configuration provides three stages of speed reduction between motor 111 and crank wheel 108. A first stage of reduction is achieved by the V-belt configuration of belt 118 extending between motor 111 and speed reducer 112. That is, the sheave of speed reducer 112 has a larger diameter than the sheave of motor 111, so that speed reduction therebetween is directly proportional to the difference in the sheave diameters. A second stage of speed reduction is achieved at speed reducer 112. That is, speed reducer 112 functions as a speed reducer and may be, e.g., a planetary-type reducer. A third stage of speed reduction is achieved between speed reducer 112 and crank wheel 108 by the V-belt configuration of belt 110 extending between speed reducer 112 and crank wheel 108. This reduction is achieved according to the same principles as the first stage.

The embodiment depicted at FIG. 1 provides several advantages over other systems known in the art. These advantages are provided by a number of subsystems that, standing alone and working in combination with one another, allow system 100 to provide, among other things, low operating torque, high operating efficiency, and less required working energy. These subsystems, as will now be described in greater detail, will generally be referred to as a Counterbalance Subsystem, a Belt Tensioning Subsystem, and a Low Speed Geometry Subsystem.

Counterbalance Subsystem

According to the preferred embodiment depicted at FIG. 1, a combination of counterbalancing methods are used to provide what is sometimes referred to herein as a counterbalance effect (CBE), which serves to reduce, or effectively counterbalance, the well torque exerted upon the system. As known by those skilled in the art, well torque generally refers to the torque placed upon the system resulting from the force of recovered fluid and the working components lifted by the system during recovery. This counterbalancing effect maximizes energy efficiency. Referring again to FIG. 1, counterbalance weights 107 are positioned along the length of walking beam 102 on the opposite side of center 104 from horse head 101. During operation of system 100, the torque exerted upon beam 102 at Sampson bearing center 104 by weights 107 serves to counterbalance the torque exerted upon beam 102 at Sampson bearing center 104 by the recovered fluid in combination with working components extending from horse head 101 (e.g., polished rod 115 and briddle line cable 116). This torque may be thought of as "opposing torque." According to a preferred embodiment, the torque exerted by weights 107 is changed in response to the opposing torque exerted upon beam 102. For example, it is typically desirable for the CBE to be increased as the opposing torque increases, e.g., during the upstroke, and to be decreased as the opposing torque decrease, e.g., during the downstroke.

According to a first counterbalancing method, the CBE provided by weights 107 is adjusted by 1) adding or removing one of a plurality of weights 107 from beam 102, and/or 2) moving weights 107 along the length of beam 102 to be closer to or further from Sampson bearing center 104. According to a preferred embodiment, this may be accomplished by using adjustment bolts and the like, or weights 107 may be actuated along the length of beam 102 using electromechanical or hydraulic mechanisms as will be apparent to those skilled in the art. The CBE provided by weights 107 could be changed at relatively short intervals, e.g., where weights 107 are moved closer to center 104 during downstroke and further from tail bearing center 104 during upstroke. Or, the CBE provided by weights 107 could be changed at relatively long intervals, e.g., in response to changing fluid levels beneath the surface. In effect, counter weights 107 balance opposing forces exerted upon bean 102, much like a teeter-totter. In this way, changing the position of counterweights 107 along walking beam 102 changes the effective counterweight provided by weights 107. Notably, an adjustable CBE is provided by counterweights 107 by virtue of the geometry of system 100. Referring to FIG. 1, which shows the position of counterweights 107 at their topmost and bottommost positions, it can be seen that the distance between the center of gravity of counterweights 107 and Sampson bearing center 104 increases as counterweights move from their top position to their bottom position. In other words, the effective counterbalance achieved by counterweights 107 increases during the upstroke (i.e., when well torque is higher) and decreases during downstroke (i.e., when well torque is lower). This aspect of the adjustable CBE provided by counterweights 107 is independent of any further actuation of counterweights using the means described above.

According to a second counterbalancing method, the CBE is further adjustable by virtue of crank wheel counterweights 117. That is, the amount of CBE caused by crank wheel counterweight 117 is adjusted by adding weights to a stack along crank wheel 108. According to a preferred embodiment, the center of gravity of crank wheel counterweights 117 is rotationally phased from a line extending between the center of crank wheel 108 and wrist pin center 105 (which, as discussed above, is joined with pitman arm 106). In the depicted embodiment, crank wheel counterweights 117 are rotationally phased by 27 degrees, lagging behind the rotational direction of wrist pin center 105. However, other useful embodiments are envisioned where crank wheel counterweights 117 are rotationally phased by an amount ranging from 0 degrees to 50 degrees. The amount of rotational phasing will depend upon specific operating configurations, including the specific dimensions or arrangement of crank wheel counterweights 117. Nevertheless, irrespective of the specific dimension of the system or the exact amount of rotational phasing, crank wheel counterweights 117 are phased to maximize their counterbalance effect about the point where the well torque load is at a maximum.

Consider the case where crank wheel 108 rotates in the counter clockwise direction and where wrist pin center 105 is slightly offset in the counter clockwise direction from its highest point during rotation about crank shaft center 109. In such case, crank wheel counterweights 117 are close to a maximum height, but slightly offset therefrom in the clockwise direction. And specifically, according to the embodiment depicted at FIG. 1, counterweights 117 are rotationally phased behind wrist pin 105 by 27 degrees. With this reference in mind, it can be easily envisioned that when wrist pin 105 has rotated ninety degrees from its initial point, the recovery unit is subject to a maximum well torque as the polished rods initially begin to lift the down hole fluid. At this point, crank wheel counterweights 117 are in position to exert their greatest CBE. Specifically, their center of gravity now fully opposes the well torque exerted upon crank wheel 108 at wrist pin center 105. In this way, system 100 lowers the magnitude of torque variation felt by the system, and therefore, energy efficiency is improved by way of a reduction in the cyclic load factor.

Figure 6:
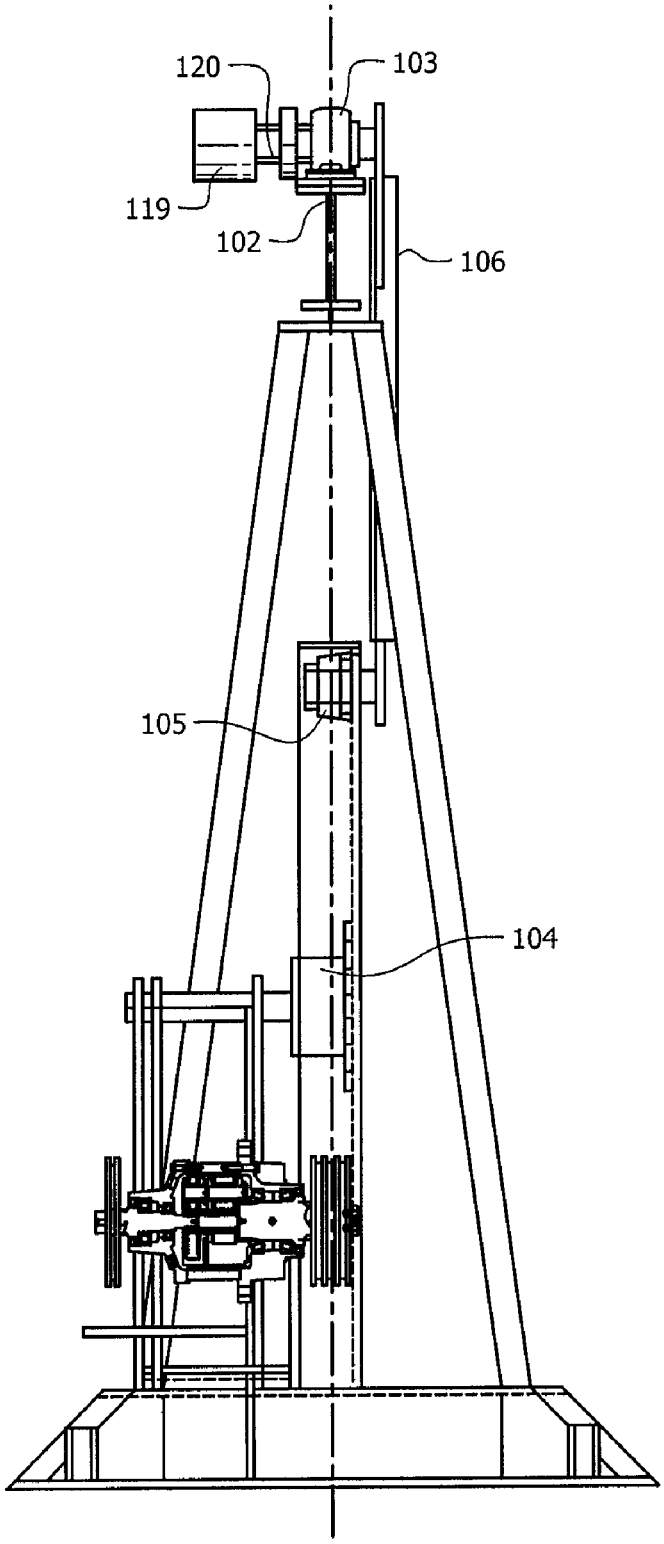
FIG. 6 is back view of a system according to a preferred embodiment of the present invention.

According to the embodiment depicted at FIG. 1 (and further seen at FIG. 6), the counterbalancing effects are further enhanced by the arrangement of pitman arm 106. Pitman arm 106 is a counterbalanced single pitman arm. Single pitman arm 106 is positioned along one side of the plane extending between tail bearing center 103 and wrist pin bearing center 105. It should be appreciated that pitman arm 106 is on the opposite side, whether it be the left or right, of crank wheel shaft 109. These bearings are of the spherical roller type and are excellent at compensating for minor misalignments of structural components. As such, the bearings will not resist or support the off balance weight of pitman arm 106. Generally, pitman arm 106 will tend to rotate around an axis line drown between the tail bearing center 103 and the wrist pin center 105. However, to counter this rotation, a counterweight 119 is added to the opposite side of tail bearing center 103. This is best seen with reference to FIG. 6. Counterweight 119 is fixed to the end of shaft extension sleeve 120, where the shaft can slide back and forth to adjust the amount of effective counterbalance. By utilizing a counterbalanced single pitman arm, all bearing centers can be aligned in a single plane. Again, as easily seen by reference to FIG. 6, tail bearing center 103, wrist pin bearing center 105, and crankshaft bearing center 109 all remain in a plane orthogonal to the horizon. By causing the bearing centers to be aligned, there are no forces causing the bearings to pull to either side. According to alternative embodiments, an extension and weight attached along pitman arm 106 and extending to a point on the opposite side of the centerline of rotation could be used to accomplish a means to counterbalance pitman arm 106.

Belt Tensioning Subsystem

Figure 2:
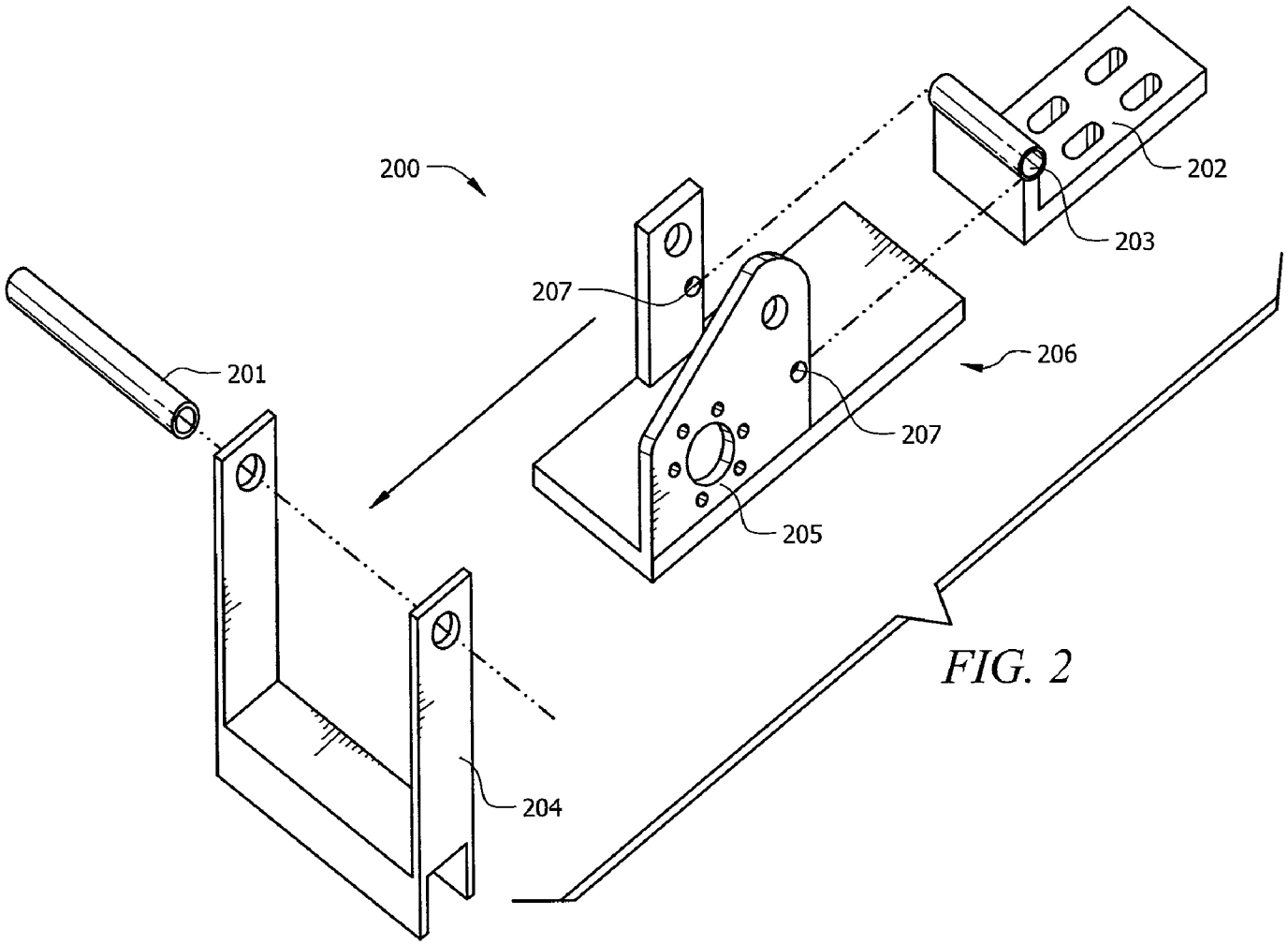
FIG. 2 is an exploded view of the tension components according to a preferred embodiment of the present invention.

A preferred embodiment of the invention described herein comprises an automatic belt tensioning subsystem, which itself comprises a first tension component (e.g. a motor swing assembly) and a second tension component (e.g., a speed reducer swing assembly). FIG. 2 is an exploded view of some components of the first and second tension components. As shown, speed reducer swing assembly 206 slideably engages automatic belt tension (ABT) swing support 204 and is held in alignment with swing support 204 as ABT shaft (or pivot point) 201 is inserted through aligned apertures of both speed reducer swing assembly 206 and ABT swing support 204. Also, motor swing assembly 202 slideably engages speed reducer swing assembly 206. Motor assembly shaft 203 (sometimes referred to as motor assembly pivot point 203) is joined at motor assembly pivot holes 207 so that motor swing assembly 202 freely rotates with respect to speed reducer swing assembly 206 about pivot point 203. When these components are assembled as described above, speed reducer swing assembly 206 rotates about ABT shaft 201 and motor swing assembly 202 rotates about pivot point 203. As will be discussed, these freedoms of rotation provided to each of motor swing assembly 202 and speed reducer swing assembly 206 provide for automatic tensioning of V-belts 118 and 110.

Figure 3:
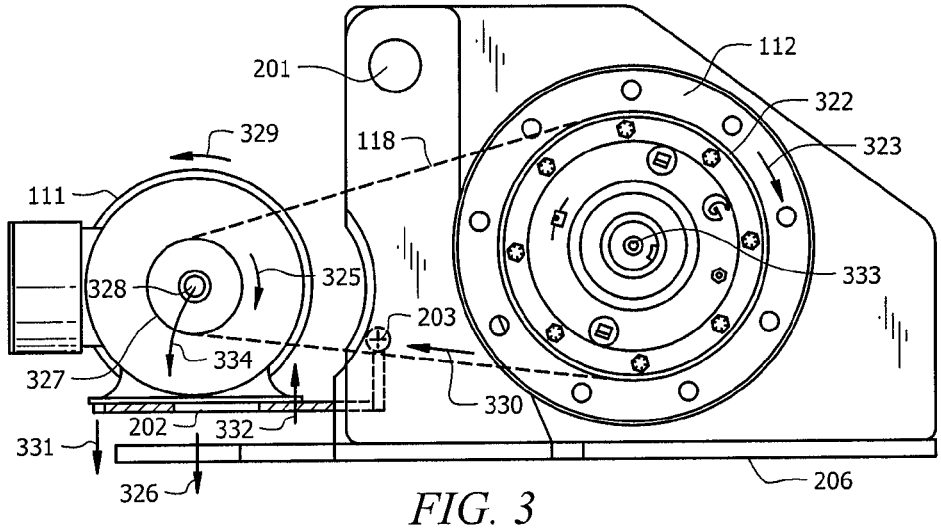
FIG. 3 is side view of a first and second tension component according to a preferred embodiment of the present invention.

FIG. 3 shows a side view of motor swing assembly 202 and speed reducer swing assembly 206. As shown, motor 111 drives speed reducer 112 using belt 118 extending therebetween. As previously discussed, according to the depicted embodiment, belt 118 is of a "V-belt" configuration, which imparts advantages to system 100. The rotation of motor swing assembly 202 about pivot point 203 operates to automatically maintain the required tension along belt 118 under varying operating conditions, i.e., varying speeds and torque loads. Motor 111 is mounted to motor swing assembly 202, which is free to rotate about pivot point 203. Motor 111 must be mounted such that belt 118 holds motor 111 and motor swing assembly 202 at a position where motor swing assembly 202 is approximately parallel to, or tilted slightly in a clockwise direction from, speed reducer swing assembly 206. In that way, belt 118 holds motor 111 in position during operation. As shown, the weight of motor 111 acts in the downward direction, shown as 326, causing motor swing assembly 202 to rotate about pivot point 203, thereby causing belt 118 to tension somewhat. Specifically, as motor swing assembly tends to rotate in the counter clockwise direction about pivot point 203 (shown as vector 334), the distance between motor 111 and speed reducer 112 increases. This increase results in an increased tension across belt 118. The resulting tension is fairly constant, albeit relatively minor because the weight of motor 111 is not overly significant.

Further, as motor 111 rotates it generates torque in direction 325. As a natural result, reactionary torque 329 is generated in motor 111 stator. As seen, reactionary torque 329 is in the opposite direction of torque 325 and directly proportional thereto. These torques are largely exerted upon motor swing assembly 202. The resulting forces exerted upon motor swing assembly 202 are depicted as force 331 and force 332, respectively. As can be easily seen, force 331 tends to push motor swing assembly 202 downward while force 332 tends to push motor swing assembly 202 upward. Moreover, force 331 has a mechanical advantage over force 332 because its torque moment felt at pivot point 203 is larger than that of force 332 (i.e., the product of force 331 and its distance from pivot point 203 is greater than the product of force 332 and its distance from pivot point 203). The sum of these forces cause swing assembly 202 to rotate about pivot point 203 in the counter clockwise direction (shown as vector 334). As such, similar to the discussion above, the distance between motor 111 and speed reducer 112 (and therefore the distance between motor shaft 328 and speed reducer shaft 333) increases, thereby causing an increase in tension across belt 118. The resulting force changes in response to changes in torque placed upon motor 111, and serves to tighten belt 118 as the torque itself changes.

Another component of automatic belt tensioning involving motor swing assembly 202 is produced as motor sheave 327 pulls on V-belt 118, i.e., as the lower (tight) side of belt 118 is pulled by motor sheave 327 in direction 330. As shown, belt 118 is below pivot point 203 of motor swing assembly 202. Because of this arrangement, when motor 111 drives belt 118 in the clockwise direction, the resulting tension on the low side of belt 118 pulls motor 111 in the counter clockwise direction around pivot point 203. This force must necessarily be offset by belt 118 at its top side, and therefore, tension is increased along that side. The output torque of motor 111 determines this force. As the load on motor 111 increases, the tension across V-belt 118 increases, and vice versa. Not only does this feature add to belt life because belt tension is relaxed when motor 111 is under minimum load, but it automatically compensates for belt and sheave wear. Further, belt 118 will not slip out and burn up due to insufficient tension.

Notably, the resulting forces described above act upon motor swing assembly 202 to rotate motor swing assembly 202 about pivot point 203 in response to changing torque conditions. As motor swing assembly 202 rotates about pivot point 203, the distance between motor 111 and speed reducer 112 varies. As can be easily seen, as the distance between motor 111 and speed reducer 112 decreases, tension across belt 118 is decreased. On the other hand, as the distance between motor 111 and speed reducer 112 increases, tension across belt 118 increases. In this way, the rotation of motor swing assembly 202 is responsive to the torque loads described above, which are exerted upon belt 118 and effective to vary the distance, and therefore the tension, between motor 111 and speed reducer 112.

Figure 4:
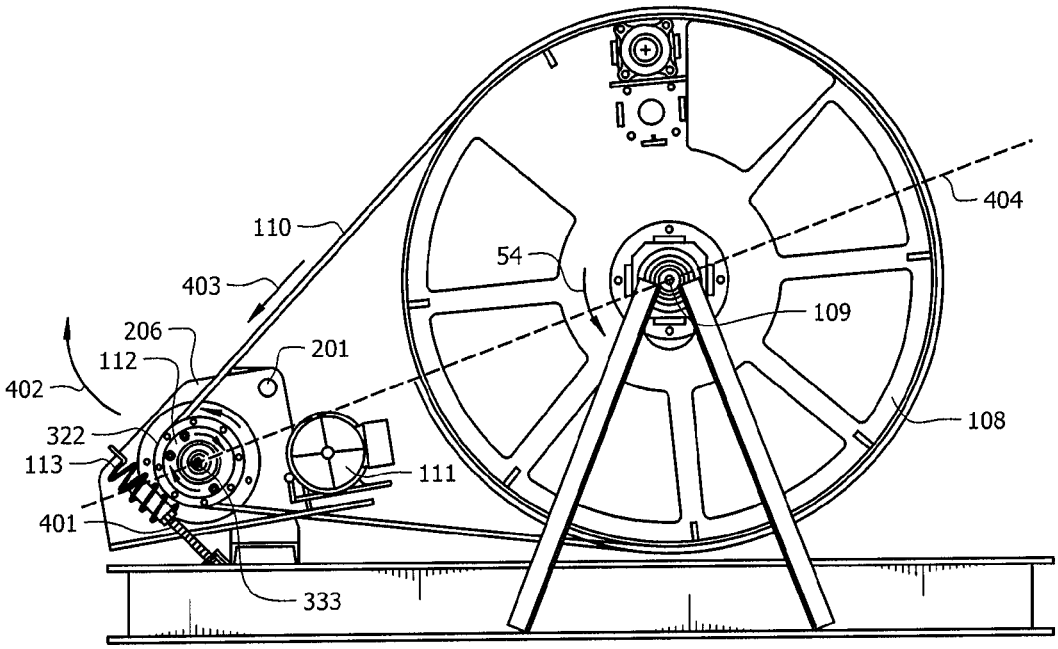
FIG. 4 is another side view of a first and second tension component according to a preferred embodiment of the present invention.

FIG. 4 depicts another view of speed reducer swing assembly 206, which also provides additional belt tensioning benefits to system 100, and its belt driven interaction with crank wheel 108. More specifically, at least three aspects of speed reducer swing assembly 206 serve to maintain tension across belt 110 (which extends between speed reducer 112 and crank wheel 108) under varying conditions, i.e., varying speeds and torque loads.

The summed forces of the weight of motor 111 and speed reducer 112 (each mounted on speed reducer swing assembly 206) tend to cause speed reducer swing assembly 206 to rotate in the counter clockwise direction about ABT pivot point 201, or more precisely in the same direction as the rotation of belt 110, shown as 403. This can be seen by reference to FIGS. 1 and 4. As speed reducer 112 rotates about ABT pivot point 201 in the direction toward crank wheel 108 (i.e., in the counter clockwise direction), the distance between the axes of rotation of gearbox sheave 322 (gearbox shaft 333) and crank wheel 108 (crank wheel shaft center 109) decreases. As a result, belt 110 tends to loosen on its low side. However, adjustable tensioning spring 113 is used to counteract this loosening of belt 110. Tensioning spring 113 may be compressed or relaxed by adjusting spring adjustment device 401. Spring adjustment device 401 may comprise a number of devices known in the art, perhaps actuated by moving a nut up or down along the length of the device. As spring 113 is compressed under the influence of speed reducer swing assembly 206, it exerts a counterforce on speed reducer swing assembly 206 that tends to cause speed reducer swing assembly 206 to rotate in the opposite direction of rotation of belt 110. As this happens, the axis of rotation of gearbox sheave 322 (gearbox shaft 333) and crank wheel 108 (crank wheel shaft center 109) increases, thereby causing belt 110 to tighten. The tension provided by spring 113 provides a minimum threshold of tension and is generally constant and independent of the load placed on belt 110.

According to another aspect of speed reducer swing assembly 206, as the load on belt 110 increases in response to a higher demand for torque to turn crank wheel 108, the tension on the top side of belt 110 increases. This higher topside belt tension, resulting from the increased torque demand, tends to cause speed reducer swing assembly 206 to rotate about ABT shaft 201 in the clockwise direction shown as vector 402. However, as seen, ABT shaft 201 is positioned between the top side of belt 110 (where the tension increase is observed) and a line extending between crankshaft center 109 and gearbox shaft 333, shown as dashed line 404. As a result of this arrangement, the clockwise rotation of speed reducer swing assembly 206 causes tension to increase along the bottom side of belt 110 (i.e., the resulting rotation of assembly 206 tends to cause the distance between speed reducer 112 and crank wheel 108 to increase). This increase in tension on the bottom side of belt 110 increases as the distance between swing assembly 206 and crank wheel 108 increases and decreases as that distance decreases. In this way, the tensioning of belt 110 can be thought of as dynamic and responsive to forces exerted upon belt 110 under changing belt speeds and torque loads. These dynamic tensioning features provide a number of advantages, namely: extension in belt life (unnecessary tension is avoided and belt slippage and burnouts are eliminated), reduction in belt and sheave wear, and reduction in system maintenance requirements.

The resulting forces described above act upon speed reducer swing assembly 206 to rotate speed reducer swing assembly 206 about pivot point 201 in response to changing torque conditions. As speed reducer swing assembly 206 rotates about pivot point 201, the distance between speed reducer 112 and crank wheel 108 varies. As can be easily seen, as the distance between speed reducer 112 and crank wheel 108 decreases, tension across belt 110 is decreased. On the other hand, as the distance between speed reducer 112 and crank wheel 108 increases, tension across belt 110 increases. In this way, the rotation of speed reducer swing assembly 206 is responsive to the torque loads described above, which are exerted upon belt 110 and effective to vary the distance and therefore the torque between speed reducer 112 and crank wheel 108.

Of course, as will be apparent to those skilled in the art, the specific directions designated as rotational directions for specific components, i.e., clockwise and counter clockwise directions, are independent of the inventive concepts described above. For example, these directions could be reversed for each component, depending upon the specific configuration of the implemented system.

Low Speed Geometry Subsystem

Figure 5:
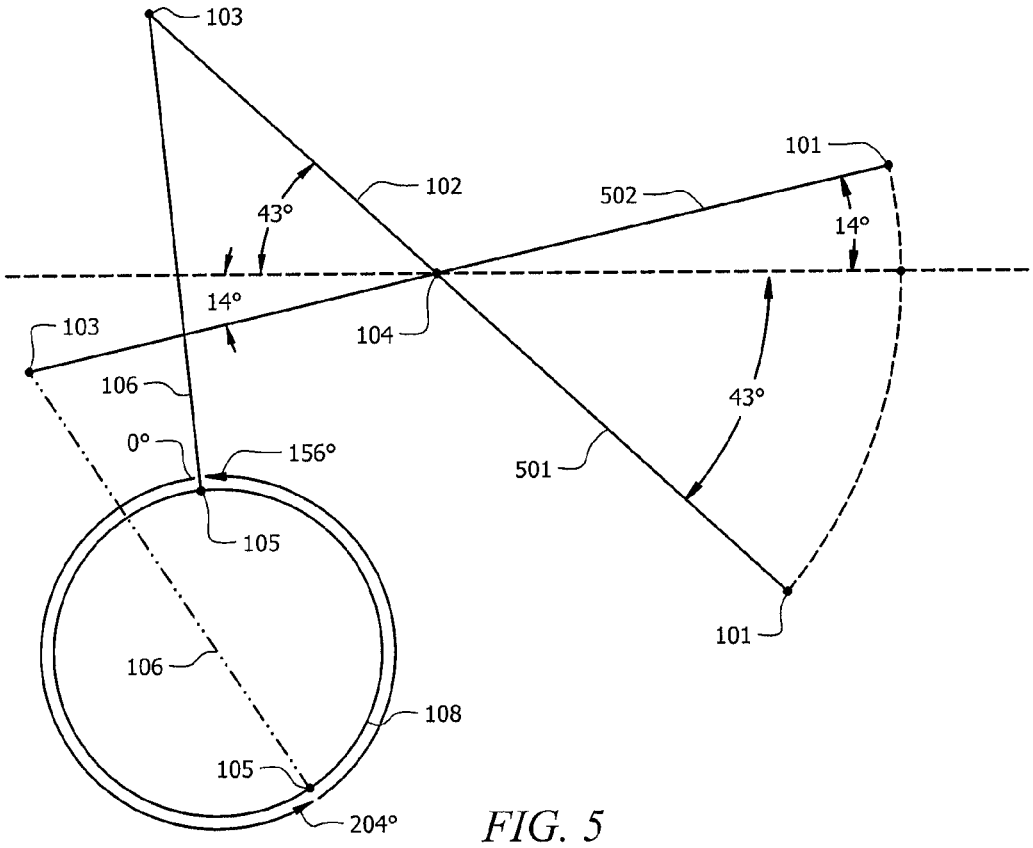
FIG. 5 is side view of a system according to a preferred embodiment of the present invention.

Preferred embodiments of the present invention provide a recovery system that is specifically designed for low speed, low volume fluid recovery. The resulting geometry allows system 100 to operate such that its upstroke is relatively slow and asymmetrical, i.e., occurring over a broader range than its downstroke. Such an upstroke avoids shock loads, reduces work, and improves overall efficiency. FIG. 5 is a schematic diagram showing the position of each end of walking beam 102 at two positions: bottom dead center (BDC) 501 and top dead center (TDC) 502. As seen, when system 100 is at BDC 501 polished rod 115 would be at its lowest position. According to the depicted geometry, the end of walking beam 102 having horse head 101 has rotated 43 degrees below horizontal at BDC 501. This position is achieved before crank wheel 108 rotates from the position where pitman arm 106 is close to its highest point, i.e., slightly offset in the counter clockwise direction from the 12 o'clock position, and at every full revolution thereafter, i.e., at 360 degrees, 720 degrees, and so on. As further seen, when system 100 is at TDC 502 polished rod 115 would be at its highest position. According to the depicted geometry, the end of walking beam 102 having horse head 101 has rotated 14 degrees above horizontal at TDC 502. Also, when system 100 is at TDC 502, crank wheel 108 has rotated 204 degrees from its position at TDC 501. The low speed geometry of system 100 is a product of the ratio of the lengths or working components comprising system 100.

As seen by reference to FIG. 5, walking beam 102 moves from BDC 501 to TDC 502 (i.e., completes the upstroke) as crank wheel 108 rotates about 204 degrees. This can be clearly seen by noting that wrist pin 105 has rotated about 204 degrees around the outer circumference of crank wheel 108 as walking beam 102 has moved from BDC 501 to TDC 502. Given the above, it follows that crank wheel 108 will rotate an additional 156 degrees as walking beam 102 moves from TDC 502 back to BDC 501 (i.e., completes the down stoke). Again, this can be clearly seen by noting that wrist pin 105 has rotated about 156 degrees around the outer circumference of crank wheel 108 as walking beam 102 has moved from TDC 502 back to BDC 501. Given this geometry, walking beam 102 moves from TDC 502 to BDC 501 over only 156 degrees of crank wheel rotation, while moving from BDC 501 to TDC 502 over about 204 degrees of crank wheel oration. Therefore, given a constant rate of crank wheel rotation, it is easily seen that the downstroke of walking beam 102 is much faster than its upstroke. The asymmetrical upstroke described above is made possible by a combination of features, including the placement of crank wheel 108 with respect to tail bearing center 103, the radius of crank wheel 108, and the ratio of linkages comprising system 100. According to the depicted embodiment, the upstroke occurs over about 204 degrees of crank wheel rotation. However, other embodiments are envisioned as being particularly advantageous in low speed, low volume applications where the upstroke occurs over a range of 190 degrees to 230 degrees of crank wheel rotation.

Figure 7:
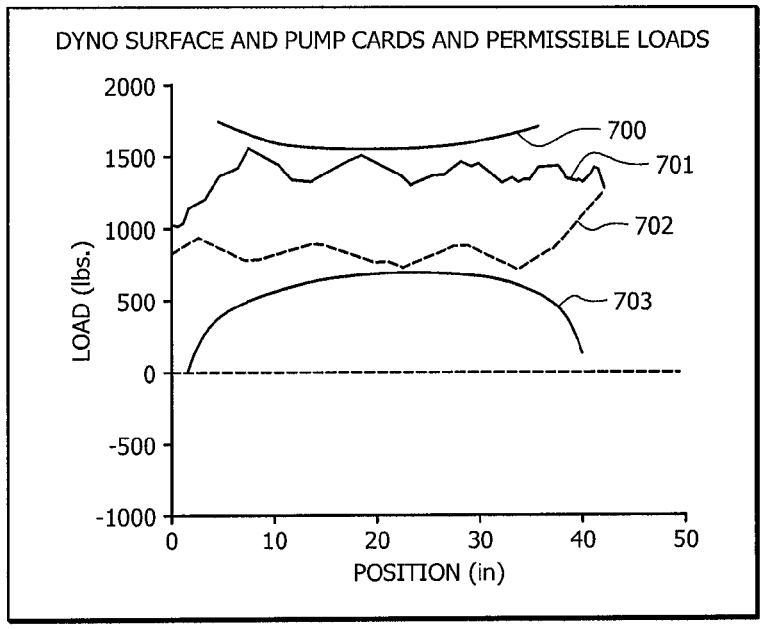
FIG. 7 is a depiction of a dynometer card according to a preferred embodiment of the present invention.

Referring to FIG. 7, surface dynometer card 700 is depicted that reflects how embodiments according to the present invention improve operating efficiency in both the upstroke and down stroke. FIG. 7 shows a typical surface dynometer card (a dynometer card is the plot of polished rod load vs. position measured at the surface). The shape of curves 701 and 702 is typical of what is generated by a recovery pump operating at a low SPM and pumping at low volume according to embodiments described herein. Specifically, curve 701 reflects a loading plot during the upstroke while curve 702 reflects a loading plot during down stroke. As seen, the combination of curves 701 and 702 roughly forms the shape of a trapezoid. As indicated, it could be said that the average value along curve 701 is fairly constant, albeit higher than the average value along curve 702. As such, it is desirable for most of the counter weighting (i.e., highest CBE) to be placed upon beam 102 to counterbalance the fairly constant upstroke loads.

The permissible load diagrams (PLD) are represented by curves 700 and 703, which are plots of the highest and lowest possible loads exerted upon the polished rod that cause the torque capacity of the unit to be fully utilized, respectively. Curve 700 corresponds to operation during upstroke, as reflected by curve 701 while curve 703 corresponds to operation during down stroke, as reflected by curve 702. The area defined by curves 700 and 703 represents the permissible range of operations and is dictated by the pumping unit geometry and the CBE. The area between the PLD curves is defined as the amount of "work" that the unit is capable of performing without being overloaded.

FIG. 7 depicts a PLD for a dynamometer card that is typically found in slow speed, low volume pumping according to a preferred embodiment of the present invention. FIG. 7 depicts a good match or compatibility between the dynamometer card and the PLD, which is typical with systems according to the present invention. For low volume pumping and low SPM, it is very desirable for the pumping unit geometry in combination with counterbalancing methods to produce a PLD that has as flat a line as possible on the upstroke. The complementary matching of the pumping units PLD with the surface dynamometer card yields lower torque requirements and ultimately lowers power requirements.

Figure 8:
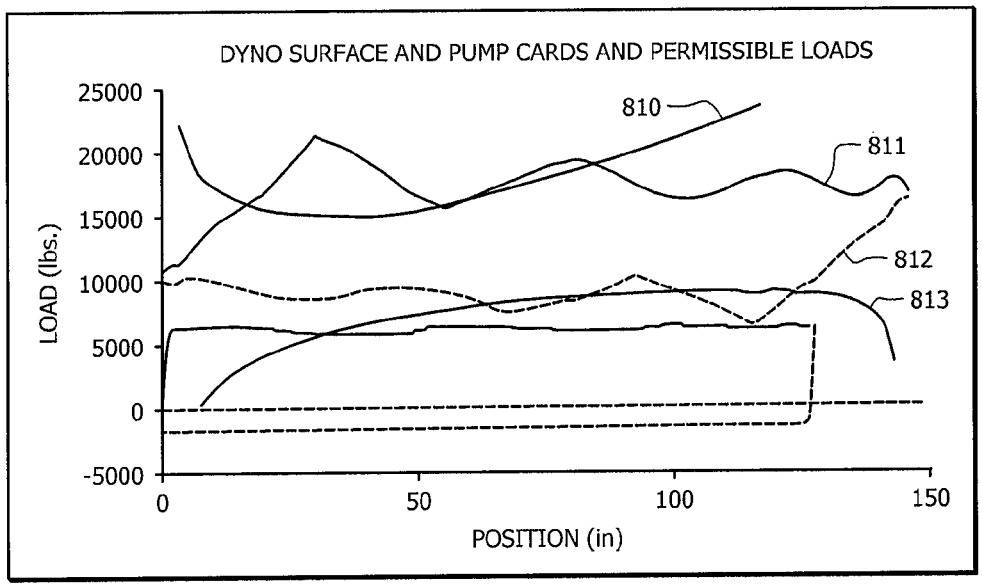
FIG. 8 is a depiction of a dynometer card according to a known recovery systems.

For purposes of comparison, FIG. 8 depicts an example of a poor match of the dynamometer card 811 and 812 with PLD 810 and PLD 813. Such an example would generally be found in higher speed systems known in the art when used in low SPM applications. The intersections of upstroke curve 811 across PLD 810 and the intersections of down stroke curve 812 across PLD 813 demonstrate where the recovery unit is overloaded.

Figure 9:
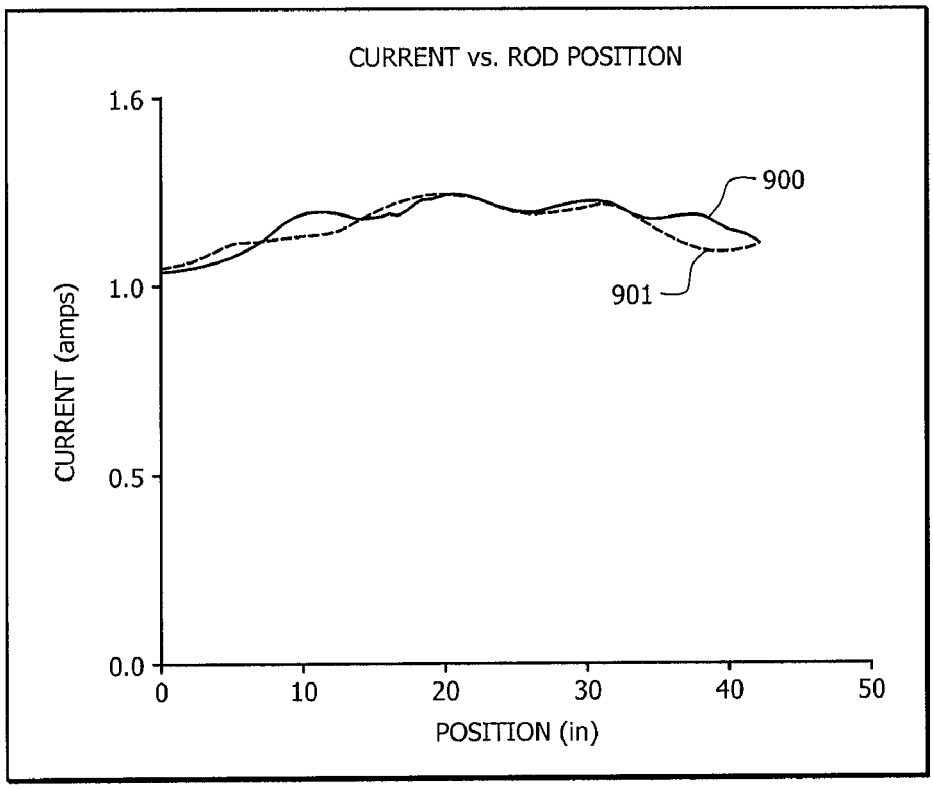
FIG. 9 is a depiction of motor current vs. rod position according to a preferred embodiment of the present invention.

FIG. 9 depicts a plot of the electric motor current versus position of the polished rod position for embodiments according to the present invention. The upstroke current plot 900 and down stroke current plot 901 come very close to overlapping and are relatively constant. As such, a motor driving a system according to the present invention can be said to be operating at a low CLF and the required amperage has only minor variations. This, of course, is extremely desirable.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method for recovering underground fluid from a well using an asymmetrical recovery motion, said method comprising:

actuating a walking beam about a first pivot point between an upstroke motion and a downstroke motion in response to rotation of a crank wheel, wherein said crank wheel:

rotates more than 180 degrees during said upstroke, and rotates less than 180 degrees during said downstroke;

wherein said walking beam and said crank wheel are in communication with one another by an arm extending there between, wherein said arm is positioned on an opposite side of said first pivot point from said well; and wherein said walking beam completes between two to five upstrokes per minute.

2. The method of claim 1 wherein an axis of rotation of said crank wheel is at a point between said first pivot point and where said arm is mated with said walking beam.

3. The method of claim 1 wherein said upstroke motion is slower than said downstroke motion.

4. The method of claim 1 wherein said crank wheel:

rotates more than 190 degrees during said upstroke, and rotates less than 170 degrees during said downstroke.

5. The method of claim 4 wherein said crank wheel:

rotates more than 200 degrees during said upstroke, and rotates less than 160 degrees during said downstroke.

6. The method of claim 5 wherein said crank wheel:

rotates more than 210 degrees during said upstroke, and rotates less than 150 degrees during said downstroke.

7. The method of claim 6 wherein said crank wheel:

rotates more than 220 degrees during said upstroke, and rotates less than 140 degrees during said downstroke.

8. A unit for recovering underground fluid from a well using an asymmetrical recovery motion, said unit comprising:

a walking beam actuated about a first pivot point between an upstroke motion and a downstroke motion in response to rotation of a crank wheel, wherein said crank wheel:

rotates more than 180 degrees during said upstroke, and rotates less than 180 degrees during said downstroke;

wherein said walking beam and said crank wheel are in communication with one another by an arm extending there between, wherein said arm is positioned on an opposite side of said first pivot point from said well; and wherein said walking beam completes between two to five upstrokes per minute.

9. The unit of claim 8 wherein an axis of rotation of said crank wheel is at a point between said first pivot point and where said arm is mated with said walking beam.

10. The unit of claim 8 wherein said upstroke motion is slower than said downstroke motion.

11. The unit of claim 8 wherein said crank wheel:

rotates more than 190 degrees during said upstroke, and rotates less than 170 degrees during said downstroke.

12. The unit of claim 11 wherein said crank wheel:

rotates more than 200 degrees during said upstroke, and rotates less than 160 degrees during said downstroke.

13. The unit of claim 12 wherein said crank wheel:

rotates more than 210 degrees during said upstroke, and rotates less than 150 degrees during said downstroke.

14. The unit of claim 13 wherein said crank wheel:

rotates more than 220 degrees during said upstroke, and rotates less than 140 degrees during said downstroke.

* * * * *